US011345148B2

(12) United States Patent
Komuro

(10) Patent No.: US 11,345,148 B2
(45) Date of Patent: May 31, 2022

(54) INKJET RECORDING HEAD

(71) Applicant: CANON KABUSHIKI KAISHA, Tokyo (JP)

(72) Inventor: Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/983,956

(22) Filed: Aug. 3, 2020

(65) Prior Publication Data

US 2021/0039387 A1 Feb. 11, 2021

(30) Foreign Application Priority Data

Aug. 9, 2019 (JP) ..... JP2019-147530

(51) Int. Cl.
*B41J 2/14* (2006.01)

(52) U.S. Cl.
CPC ..... *B41J 2/14072* (2013.01); *B41J 2/1433* (2013.01)

(58) Field of Classification Search
CPC ..... B41J 2/14072; B41J 2/1433
See application file for complete search history.

(56) References Cited

U.S. PATENT DOCUMENTS

2007/0008375 A1* 1/2007 Tanikawa ..... B41J 2/1625 347/50
2008/0024542 A1* 1/2008 Miyazaki ..... B41J 2/1433 347/20

FOREIGN PATENT DOCUMENTS

JP H07-276643 A 10/1995
JP 2001-138520 A 5/2001

* cited by examiner

*Primary Examiner* — Jason S Uhlenhake
(74) *Attorney, Agent, or Firm* — Canon U.S.A., Inc. I.P. Division

(57) ABSTRACT

An inkjet recording head includes an ejection chip having ejection orifices an external wiring board for applying an electrical signal, an electrical joining portion in which an external wiring of the external wiring board and the ejection chip are electrically joined, and a resin-sealed portion for sealing the electrical joining portion, in which a first spacer is provided between the electrical joining portion and a member in which the ejection orifices are formed, a second spacer is provided in a region outside a formation region of the external wirings, electrode bumps of the ejection chip and the external wirings of the external wiring board are joined to each other in the electrical joining portion, and the first spacer and the second spacer are joined to each other.

13 Claims, 18 Drawing Sheets

INKJET RECORDING HEAD

BACKGROUND

Field of the Disclosure

The present disclosure relates to an inkjet recording head.

Description of the Related Art

An inkjet recording head generally includes an ejection chip in which pressure generating elements, electrical wirings, lead-out electrode pads, nozzles, and ejection orifices are formed on a substrate in order to eject ink by an electrical signal. An external wiring board is electrically mounted on the ejection chip in order to apply the electrical signal to the ejection chip from the outside.

Japanese Patent Application Laid-Open No. H07-276643 describes an inkjet recording head including an ejection chip in which an electrode pad row is aligned in the same direction as an ejection orifice row. In this ejection chip, the electrode pad row is arranged in a region shorter than a width of the ejection orifice row of the ejection chip.

Japanese Patent Application Laid-Open No. 2001-138520 describes an inkjet recording head in which an ejection chip and an external wiring board are electrically mounted. The electrical mounting includes bumps which are formed on electrode pads, and the electrical wirings of the external wiring board and the bump are electrically joined to each other by an anisotropic conductive film (ACF).

A conventional inkjet recording head including the ejection chip and the external wiring board will be described by taking the conventional inkjet recording head illustrated in FIG. 17, FIG. 18A and FIG. 18B as an example.

The ejection chip includes the pressure generating elements, the electrical wirings, the lead-out electrode pads, the nozzles (not illustrated), and an orifice portion 103 in which a plurality of ejection orifices 104 is arrayed in a predetermined direction on a substrate 101. An external wiring board 109 including wirings 107 for applying an electrical signal from the outside is electrically mounted on the ejection chip. The wirings 107 of the external wiring board are electrically joined to the electrode pads of the ejection chip via bumps 105. This electrical joining portion is sealed with a resin-sealed portion 110. The electrical joining portion is protected from ink by the resin sealing material.

When the external wiring board 109 and the ejection chip are electrically joined to each other, since the electrical joining portion between the ejection chip and the external wiring board has a one-dimensional array (bumps 105 are arrayed linearly), a substrate surface of the ejection chip and the external wiring board 109 may not be joined in parallel. This may cause the electrical reliability of the electrical joining portion to decrease. Since a distance between the ejection chip and the external wiring board may not be constant when the electrical joining portion is subjected to resin sealing, the resin sealing material may be poured unevenly and the resin sealing might be defective. In such a case, the ink may penetrate into the resin sealing material during long-term use, and a wiring of the external wiring board may be corroded.

SUMMARY

According to one aspect of the present disclosure, there is provided an inkjet recording head comprising an ejection chip in which a plurality of ejection orifices for performing ejection is arrayed, an external wiring board for applying an electrical signal from the outside to the ejection chip, an electrical joining portion in which external wirings of the external wiring board and the ejection chip are electrically joined, and a resin-sealed portion for sealing the electrical joining portion, wherein a first spacer is provided in the ejection chip between the electrical joining portion and a member in which the ejection orifices are formed, a second spacer is provided in a region outside a formation region of the external wirings in the external wiring board, electrode bumps of the ejection chip and the external wirings of the external wiring board are joined to each other in the electrical joining portion, and the first spacer of the ejection chip and the second spacer of the external wiring board are joined to each other.

Further features of the present disclosure will become apparent from the following description of exemplary embodiments with reference to the attached drawings.

DESCRIPTION OF THE EMBODIMENTS

Figure 1:
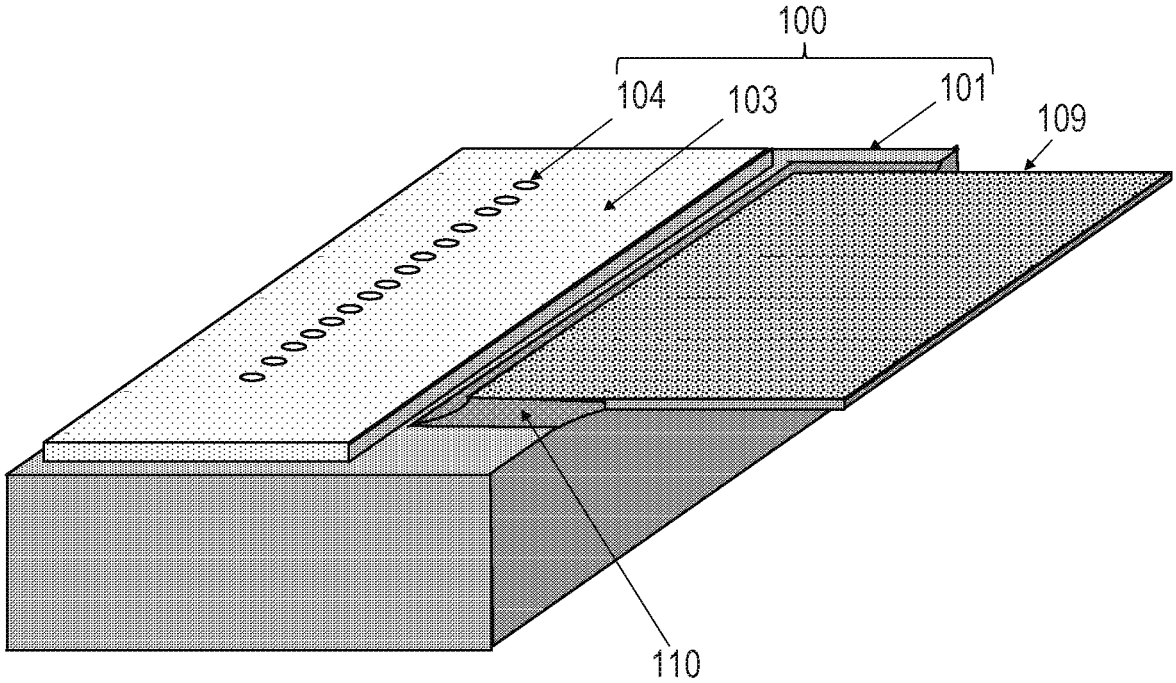
FIG. 1 is a perspective view of an inkjet recording head according to an embodiment of the present disclosure.
Figure 2A:
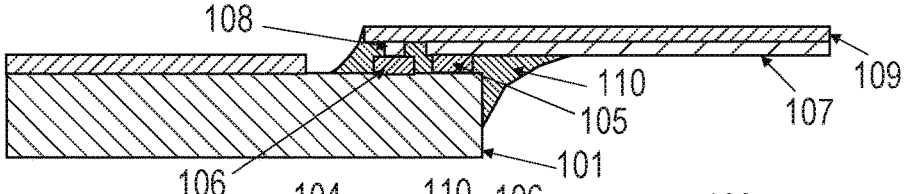
FIG. 2A is a cross-sectional view taken along line IIA-IIA of FIG. 2B.
Figure 2B:
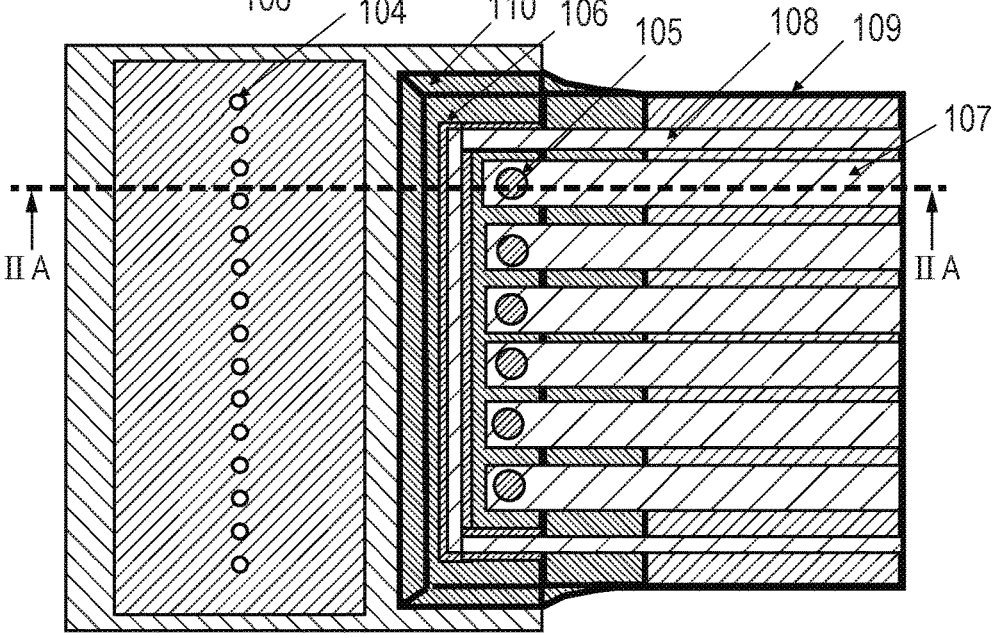
FIG. 2B is a perspective view seen from a front surface side of an external wiring board.

Hereinafter, an embodiment of the present disclosure will be described with reference to the accompanying drawings. First, a basic configuration will be described. An inkjet recording head of the embodiment of the present disclosure includes an ejection chip for ejecting ink and an external wiring board for applying an electrical signal to the ejection chip from the outside. As illustrated in FIG. 1, FIG. 2A and FIG. 2B, an ejection chip 100 includes a substrate 101, pressure generating elements provided on the substrate, electrical wirings for transmitting an electrical signal to the pressure generating elements, and lead-out electrode pads (not illustrated) electrically connected to the electrical wirings. The ejection chip 100 also includes a member (orifice portion) 103 in which nozzles (not illustrated) and ejection orifices 104 are formed. The pressure generating elements are provided corresponding to the ejection orifices. A portion including at least one end portion (first end portion 109*a*) of an external wiring board 109 is arranged on the substrate 101 of the ejection chip and electrically connected thereto.

As the external wiring board 109, as illustrated in FIG. 2A and FIG. 2B, an external wiring board in which wirings made of a conductive material are formed as the external wirings 107 on a base can be used. The external wirings 107 extend from a first end portion of the external wiring board arranged on an ejection chip side toward a second end portion facing the first end portion. The external wirings 107 may be linear wirings, for example. As illustrated in FIG. 2B, a plurality of such external wirings 107 can be arrayed, and can be formed in a line and space pattern, for example.

Figure 4:
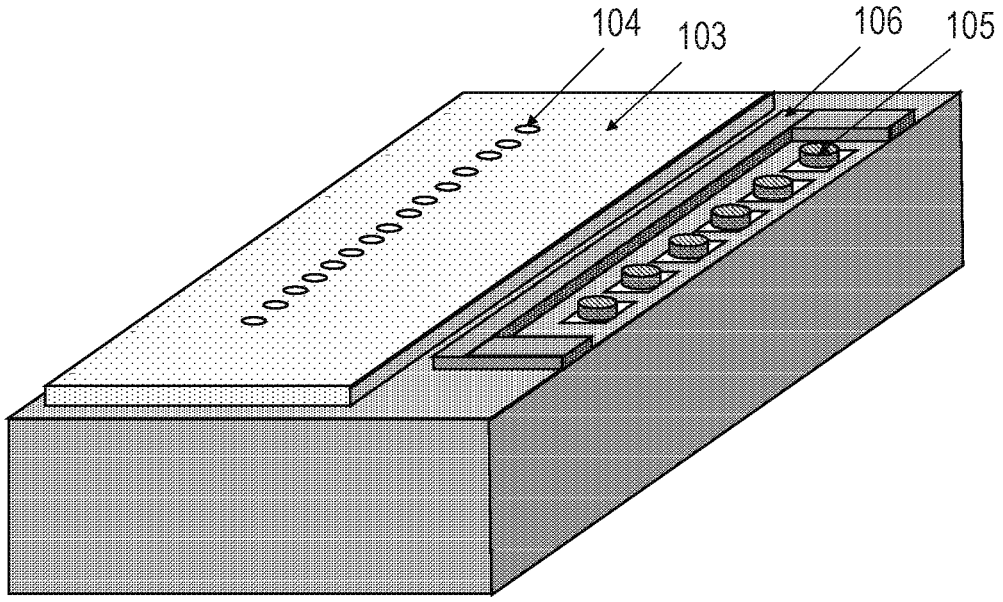
FIG. 4 is a perspective view of a manufacturing step following FIG. 3 of the inkjet recording head according to the embodiment of the present disclosure.
Figure 5:
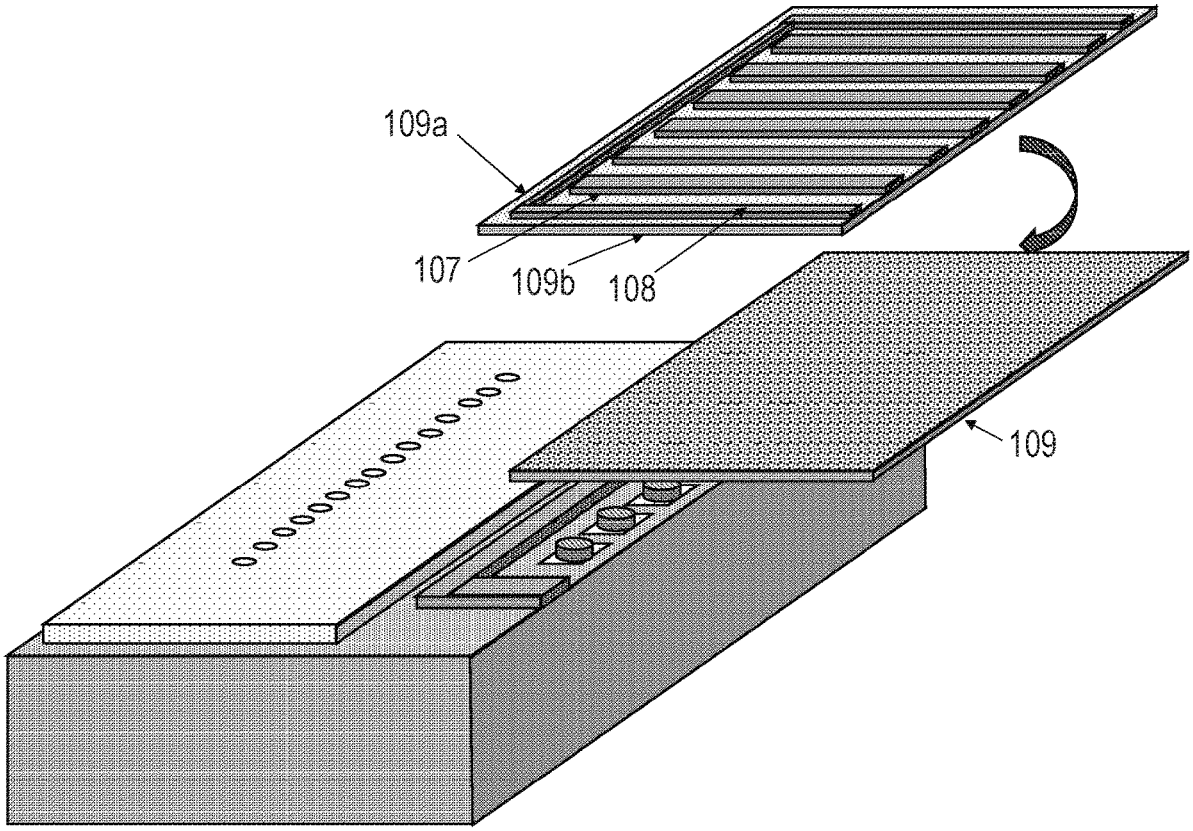
FIG. 5 is a perspective view of a manufacturing step following FIG. 4 of the inkjet recording head according to the embodiment of the present disclosure.
Figure 6:
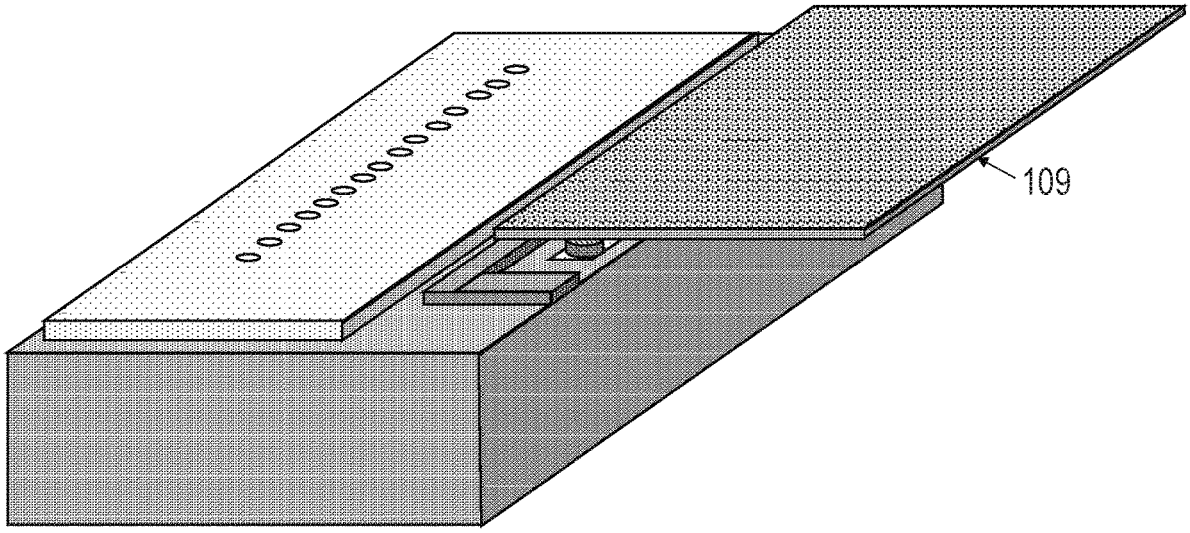
FIG. 6 is a perspective view of a manufacturing step following FIG. 5 of the inkjet recording head according to the embodiment of the present disclosure.
Figure 7:
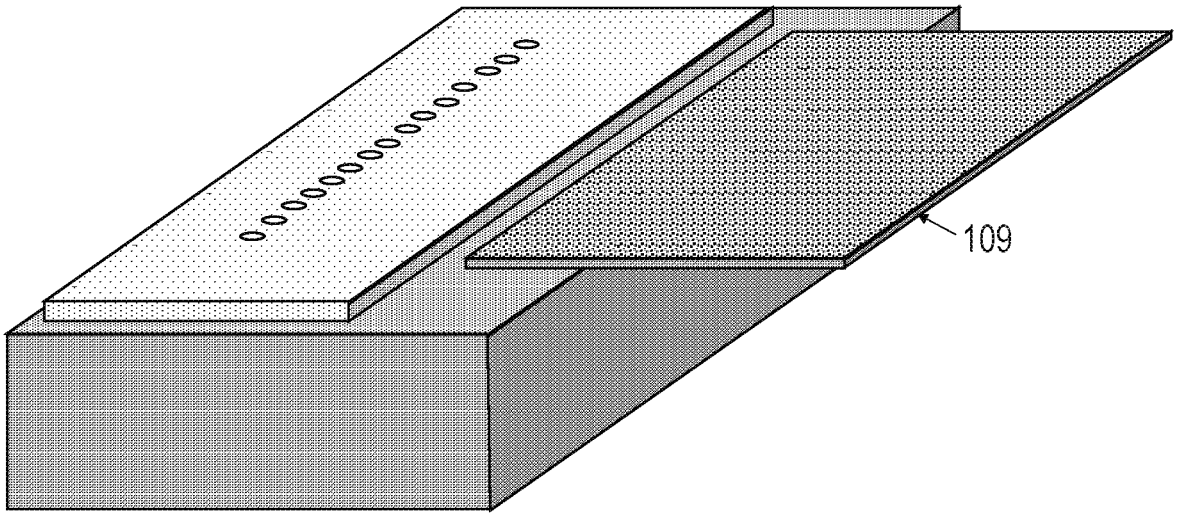
FIG. 7 is a perspective view of a manufacturing step following FIG. 6 of the inkjet recording head according to the embodiment of the present disclosure.

As illustrated in illustrated in FIG. 2A and FIG. 2B, the ejection chip and the external wirings 107 of the external wiring board are electrically joined to the lead-out electrode pads of the ejection chip via electrode bumps 105 to form an electrical joining portion. The lead-out electrode pads can be arrayed along an array direction of the ejection orifices 104, as indicated by the reference numeral 102 in FIG. 3 and FIG. 4 described later. Then, each electrode bump 105 is provided on each electrode pad 102. As illustrated in FIG. 5, which will be described later, a portion including the first end portion 109*a* of the external wiring board is overlapped with one end portion on the substrate of the ejection chip in which the electrode bumps 105 are formed, and the external wirings 107 are connected to the electrode bumps 105. In this way, in the portion where the external wiring board and the ejection chip overlap, the electrode bumps of the ejection chip and the external wirings of the external wiring board are joined to each other, and the external wirings are electrically joined to the lead-out electrode pads via the electrode bumps to form the electrical joining portion.

The electrical joining portion is sealed with a resin sealing material to form a resin-sealed portion 110. The electrical joining portion is protected from ink by the resin-sealed portion 110. The resin-sealed portion can be formed by causing the resin sealing material to flow to be poured into a gap between the ejection chip and the external wiring board by a capillary force. The resin sealing material stops at the end portion of the ejection chip and the end portion of the external wiring board due to surface tension, and can be formed into a shape illustrated in FIG. 1, FIG. 2A and FIG. 2B.

In order to form the structure described above, the external wiring board has the end portion arranged within a width of the ejection chip in an ejection orifice array direction, that is, a width of the external wiring board in the ejection orifice array direction is narrower than the width of the ejection chip in the same direction. The width of the external wiring board in the ejection orifice array direction can be shorter than the width of the orifice portion 103 in the same direction. Since the width (the length of the first end portion) of the external wiring board in the ejection orifice array direction is sufficiently narrower than the width of the ejection chip, the resin-sealed portion can be formed with a sufficient size, on the substrate of the ejection chip, along the outer edge of the external wiring board.

The inkjet recording head according to the embodiment of the present disclosure has the following configuration in order to improve electrical reliability in the configuration described above. That is, in the ejection chip, the first spacer is provided between the electrode bumps and the orifice portion, and in the external wiring board, the second spacer is provided in a region on the first end portion side of the formation region of the external wiring. The electrode bumps of the ejection chip and the external wirings of the external wiring board are joined to each other, and the first spacer of the ejection chip and the second spacers of the external wiring board are joined to each other. The first spacer is arranged in at least the same length as the length of the array of the electrode bumps along an array direction of the electrode bumps. The second spacer is arranged in at least the same length as the length of the array of the external wirings along the first end portion of the external wiring board.

In such a configuration, as described below, in a step of electrically joining the electrode bumps of the ejection chip and the external wirings of the external wiring board, parts to be joined can be arranged two-dimensionally.

For example, on the ejection chip side, a linear spacer extending along the array direction of the electrode bumps can be arranged as the first spacer. As illustrated in FIG. 4, as the first spacer 106, a U-shaped linear spacer made of the same material as the electrode bumps can be arranged. That is, a U-shaped linear spacer can be arranged around the electrode bump 105 so as to separate the row of the electrode bumps 105 and the orifice portion 103 from each other between the row of the electrode bumps 105 and the orifice portion 103.

On the external wiring board side, as illustrated in FIG. 5, a wiring material can be arranged as the second spacer 108 on the outside of the formation region of the external wirings 107. The second spacer includes a linear portion extending along the first end portion, and the linear portion has at least the same length as the length of the array of the external wirings. The second spacer includes linear portions extending along the external wirings on both outer sides of the array of the external wirings, and the linear portions are arranged for the second spacer. The second spacers are arranged so as to surround the external wirings on both outer sides of the array of the plurality of external wirings. The second spacer 108 may be arranged at least in the same length as the array length of the external wirings along the first end portion 109*a* of the external wiring board 109 on the ejection chip side, and may be formed in a shape other than the line shape, for example, in the shape of a plurality of dots. Since the first spacer 106 and the second spacer 108 are made of the same material as the electrode bumps and the external wirings, respectively, when the electrode bumps and the external wirings are subjected to metal-joining, the first spacer 106 and the second spacer 108 are similarly metal-joined to each other so that joining with high joining strength can be performed.

The second spacer 108 thus provided is joined to the first spacer 106 when the ejection chip and the external wiring board are joined to each other (FIG. 2A, FIG. 2B, FIG. 8A and FIG. 8B). The joining portion between the first spacer 106 and the second spacer 108 and the joining portions between the electrode bumps 105 and the external wirings 107 can be arranged two-dimensionally (planar arrangement). As a result, a substrate surface of the ejection chip and the external wiring board 109 are joined to each other in parallel, and electrical reliability of the electrical joining portion can be secured. Further, the resin sealing material can be poured evenly and reliability of the resin-sealed portion can be secured.

Figure 10:
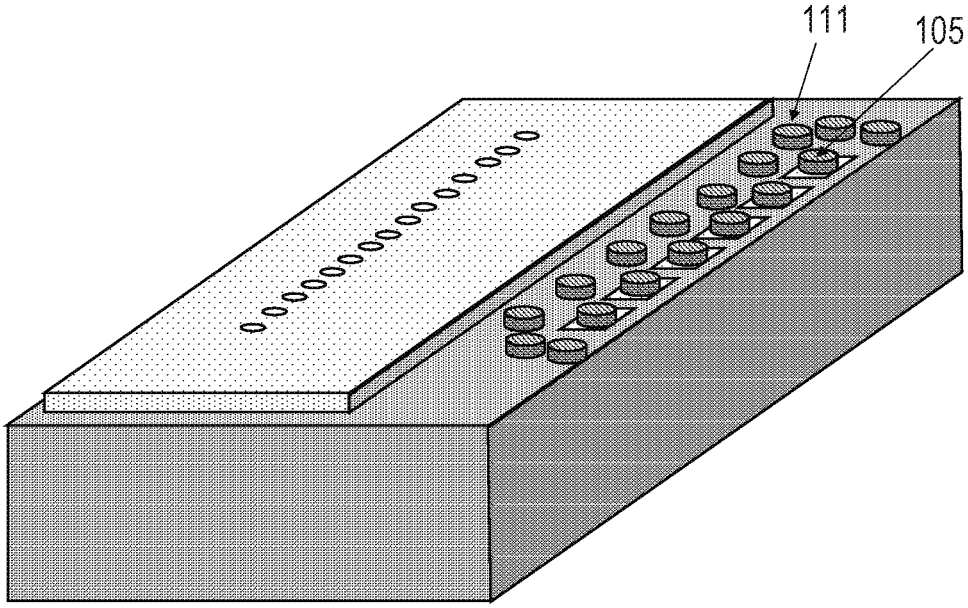
FIG. 10 is a perspective view of a manufacturing step subsequent to FIG. 9 of the inkjet recording head according to another embodiment of the present disclosure.
Figure 11:
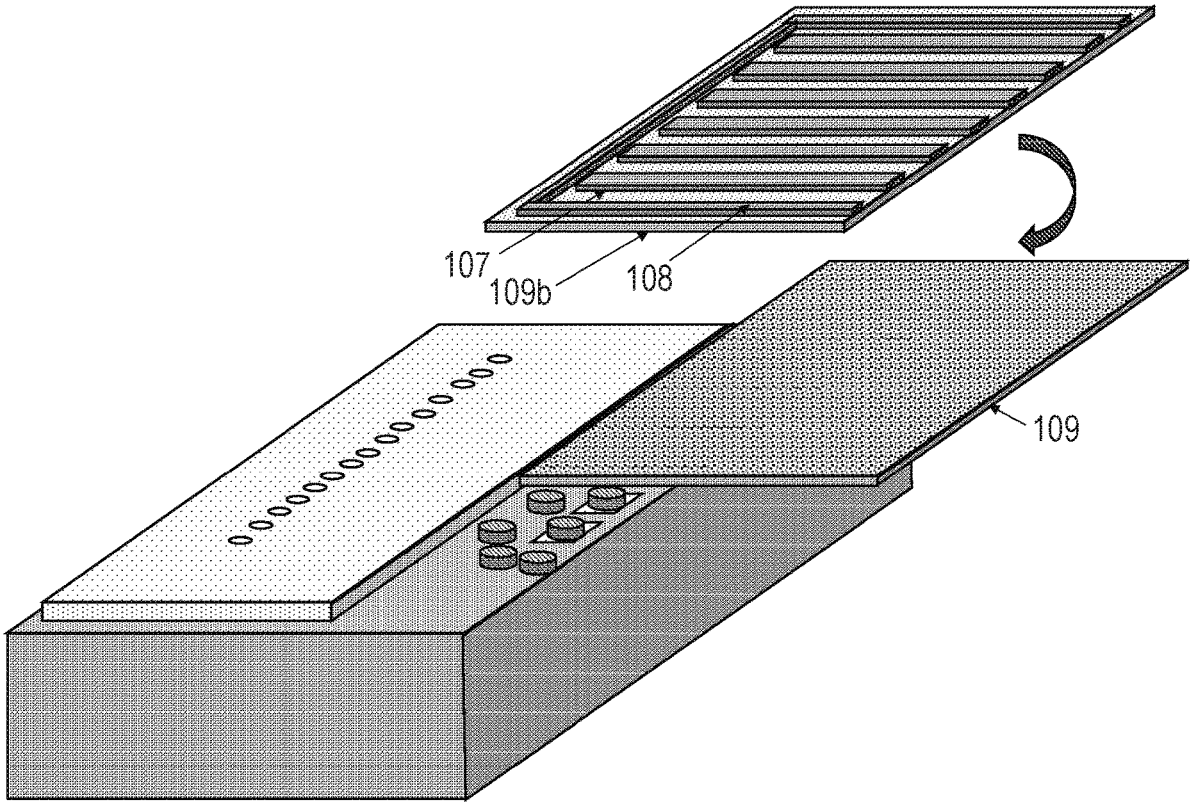
FIG. 11 is a perspective view of a manufacturing step subsequent to FIG. 10) of the inkjet recording head according to another embodiment of the present disclosure.
Figure 12:
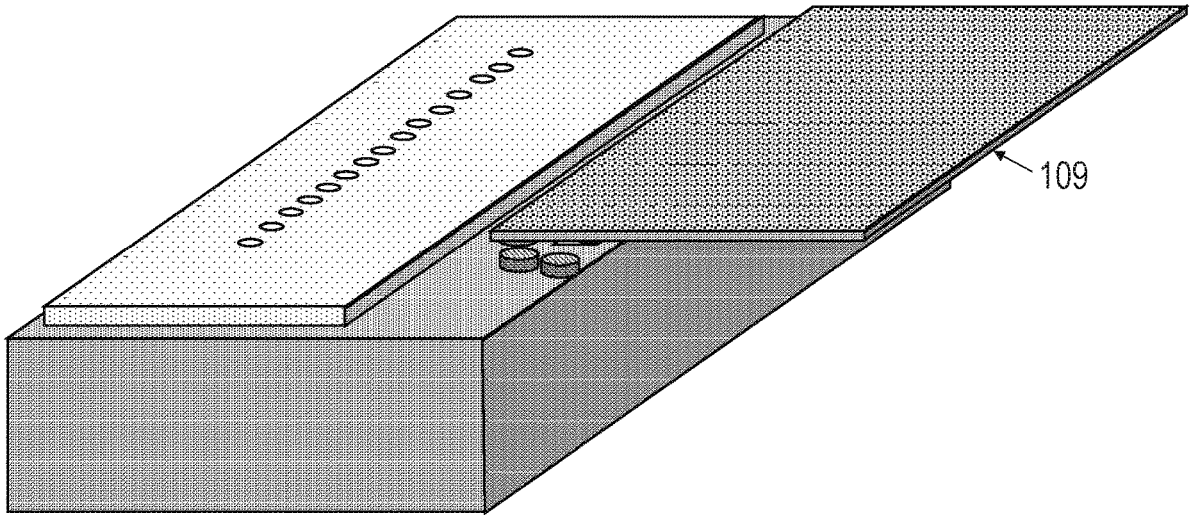
FIG. 12 is a perspective view) of a manufacturing step subsequent to FIG. 11 of the inkjet recording head according to another embodiment of the present disclosure.
Figure 13:
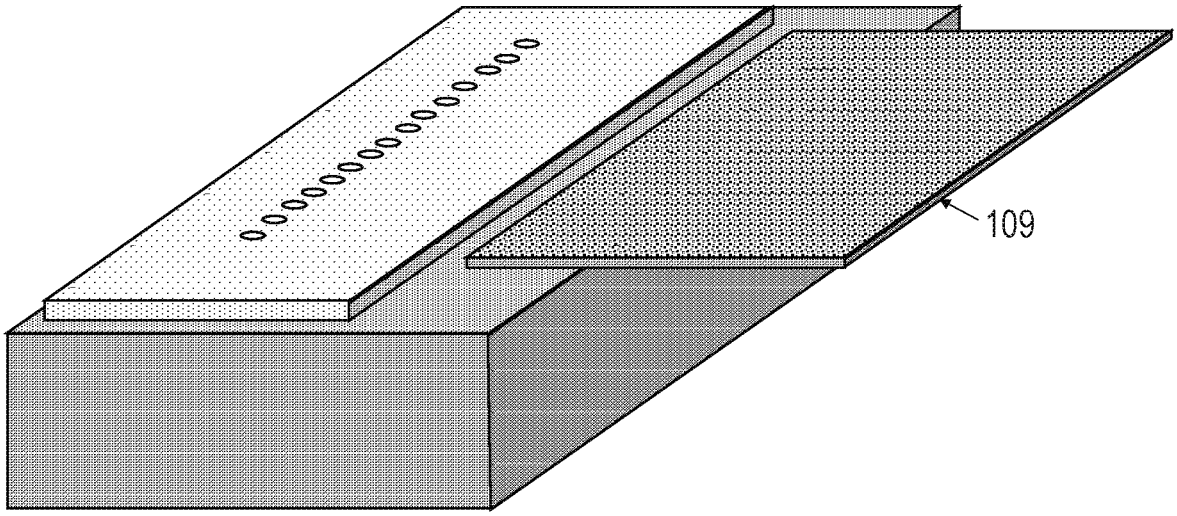
FIG. 13 is a perspective view of a manufacturing step subsequent to FIG. 12 of the inkjet recording head according to another embodiment of the present disclosure.
Figure 14A:
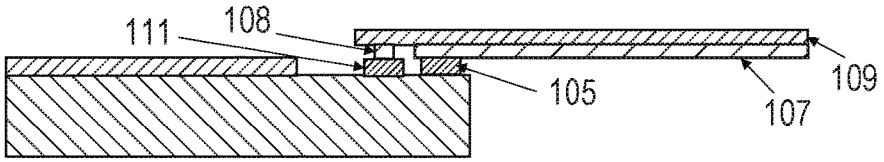
FIG. 14A is a cross-sectional view taken along line XIVA-XIVA of FIG. 14B.
Figure 14B:
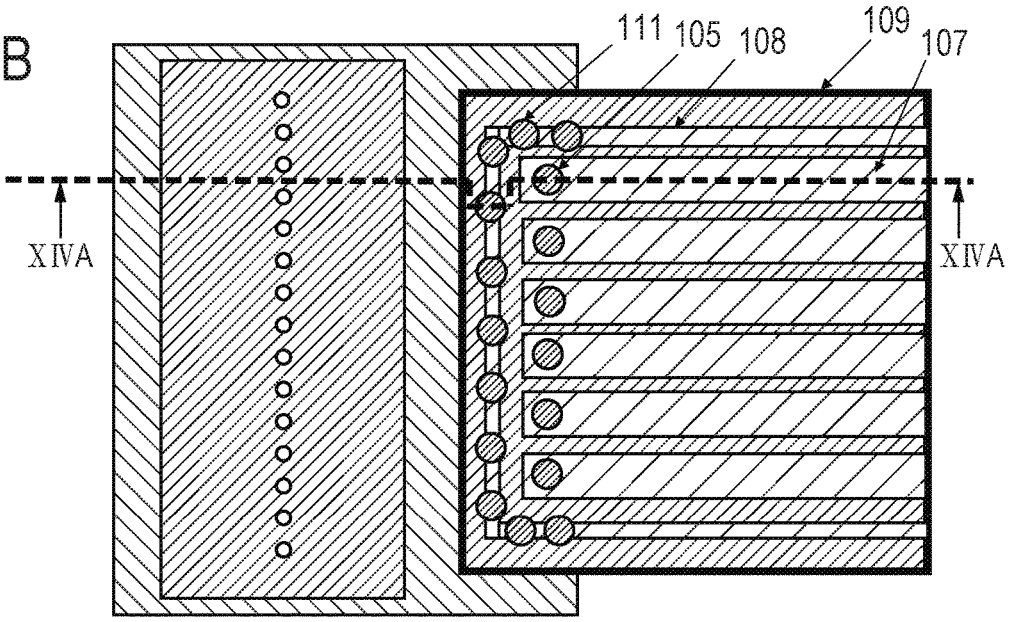
FIG. 14B is a perspective view seen from the front surface side of the external wiring board.

As another example, as illustrated in FIG. 10, instead of the linear first spacer 106, a row of a plurality of bump-shaped first spacers 111 can be arranged on the ejection chip side. The row of the bump-shaped first spacers includes a row of bump-shaped spacers arrayed along the array direction of the electrode bumps. In contrast to such bump-shaped first spacers, as the second spacer 108 of the external wiring board, the same one as illustrated in FIG. 5 can be used as illustrated in FIG. 11. The second spacer 108 is joined to the bump-shaped first spacers 111 when the ejection chip and the external wiring are joined to each other (FIG. 14A and FIG. 14B). Such a joining portion between the first spacers 111 and the second spacer 108 and the joining portions between the electrode bumps 105 and the external wirings 107 are two-dimensionally arranged (planar arrangement) so that the substrate surface of the ejection chip and the external wiring board 109 are joined to each other in parallel.

In this way, by joining the ejection chip and the external wiring board, an inclination of the external wiring board with respect to the substrate of the ejection chip does not occur and electrical reliability can be improved at the electrical joining portion.

In the joining structure described above, a distance (a size of the gap in the overlapping portion between the ejection chip and the external wiring board) between the ejection chip and the external wiring board can be made constant. As a result, sealing by pouring the resin sealing material can be stably performed, and a good resin-sealed portion can be formed in the electrical joining portion.

In the joining illustrated in FIG. 2A and FIG. 2B, the linear second spacer 108 illustrated in FIG. 5 that follow the arrangement of the linear first spacer 106 illustrated in FIG. 4 is provided and joined to the first spacer 106. When the first spacer and the second spacer are joined in this way, the joining portion between the first spacer and the second spacer can be functioned as a blocking wall of ink. Even if ink penetrates into the resin-sealed portion, the ink can be blocked at this joining portion. As a result, occurrence of corrosion in electrode pad, electrode bump, and external wiring due to ink can be prevented and electrical reliability can be further improved. Furthermore, when the first spacer and the second spacer are made of a conductive material, corrosion of the second spacer 108 of the external wiring board can be prevented by setting the first spacer 106 on the ejection chip side to a ground potential GND.

Hereinafter, the structure of the inkjet recording head according to the embodiment of the present disclosure will be described in detail while describing the manufacturing steps thereof.

First, a step of forming the ejection chip will be described with reference to FIG. 3 and FIG. 4. On the silicon substrate 101, pressure generating elements, electrical wirings (both not illustrated) for supplying electricity to drive the pressure generating elements, and electrode pads 102 for electrically connecting to the outside are formed.

Next, the electrode bumps 105 and the linear first spacer 106 are formed on the lead-out electrode pads 102 by gold plating or the like. The electrode bumps 105 and the first spacer 106 can have the same height. In the example illustrated in FIG. 3, the first spacer 106 is arranged in a U shape so as to cover both ends of the electrode bumps 105 in the array direction.

Next, ink supply ports (not illustrated) for supplying ink to the pressure generating elements are formed on the silicon substrate 101. Subsequently, as illustrated in FIG. 4, the orifice portion 103 including the nozzles for ejecting ink communicating with the ink supply ports and the ejection orifices 104 is formed. The array of the electrode pads of the ejection chip is arranged in a region shorter than the ejection orifice row in the same direction as the ejection orifice row. In this way, the ejection chip of this embodiment can be manufactured.

On the other hand, as illustrated in FIG. 5, as the external wiring board 109 for applying an electrical signal to the ejection chip, one in which the external wirings 107 and a wiring layer as the second spacer 108 outside the external wirings are formed on a base material 109*b* can be used.

As the base material of the external wiring board, a flexible film made of a heat resistant resin such as Kapton (registered trademark) or Upilex (registered trademark) can be used. The base material of the external wiring board may be a rigid material such as glass epoxy.

On such a base material, the external wiring 107 for metal joining with the electrode bump 105 and the second spacer 108 for joining with the first spacer 106 are made of metal such as copper. A joining metal such as gold may be further formed on the metal joining portions of the external wirings and the second spacer.

Next, as illustrated in FIG. 5 to FIG. 8A and FIG. 8B, the external wiring board is attached to the ejection chip. In this case, the electrode bumps 105 and the first spacer 106 on the ejection chip are respectively metal-joined to the external wirings 107 and the second spacer 108 on the external wiring board by ultrasonic waves or thermocompression. In this way, since the electrode bumps and the first spacer are two-dimensionally arranged on the same surface in the portion to be metal-joined, the inclination of the external wiring board with respect to the ejection chip can be suppressed in metal-joining. As a result, a good joining portion can be formed. The electrode bumps and the first spacer of the ejection chip are formed at the same height and made of the same material, and the external wirings and the second spacer of the external wiring board are formed at the same height and made of the same material, and thus a joining thickness between the electrode bumps and the external wirings is the same as the joining thickness between the first spacer and the second spacer.

After that, a gap portion between the ejection chip and the external wiring board is sealed with a resin sealing material to form the sealed portion 110 as illustrated in FIG. 1, FIG. 2A and FIG. 2B. In metal-joining, since the external wiring board can be joined to the ejection chip without being inclined, the distance between the ejection chip and the external wiring board can be made constant. For that reason, sealing by pouring the resin sealing material by the capillary force can be performed stably.

In this way, an ejection module in which the external wiring board is electrically mounted on the ejection chip can be obtained. The ejection module is mounted on a member to which ink is supplied (flow path plate), and the external wiring board is electrically connected to a circuit board to complete the inkjet recording head.

As described above, the ejection module manufactured by electrically mounting the external wiring board on the ejection chip to be subjected to resin sealing has a configuration as illustrated in FIG. 2A. That is, the first spacer 106 of the ejection chip and the second spacer 108 of the external wiring board corresponding to the first spacer 106 are joined to each other on the outside of the joining portion between the electrode bumps 105 corresponding to the electrode pads of the ejection chip and the external wirings 107 of the external wiring board. This joining portion serves as a blocking wall for ink that penetrates into the resin-sealed portion from the outside. Therefore, the ink does not reach the electrode bumps 105 on the electrode pads 102 and the external wirings 107 of the external wiring board, and thus corrosion of the electrode pads 102, the electrode bumps 105, and the external wirings 107 can be prevented, and electrical reliability can be further improved.

Furthermore, by setting the second spacer 108 of the external wiring board corresponding to the first spacer 106 of the ejection chip to the ground GND potential, occurrence of a local cell between both joining metals when the ink penetrates into can be prevented. Therefore, corrosion of the joining portion between the first spacer and the second spacer can be prevented, and thus the joining portion can maintain the function as an ink blocking wall.

Figure 9:
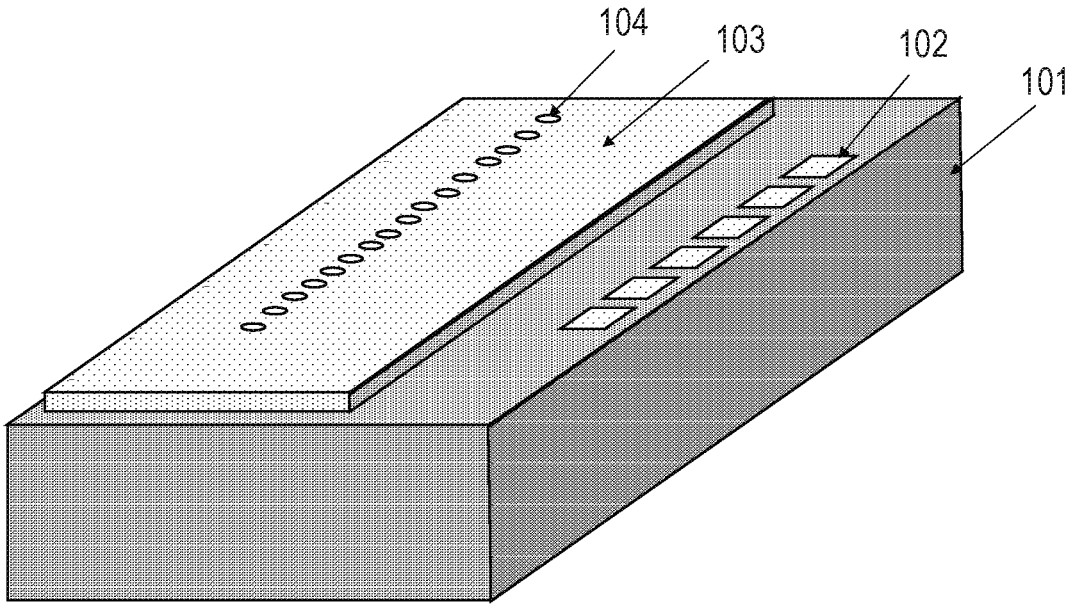
FIG. 9 is a perspective view of a manufacturing step of an inkjet recording head according to another embodiment of the present disclosure.
Figure 15:
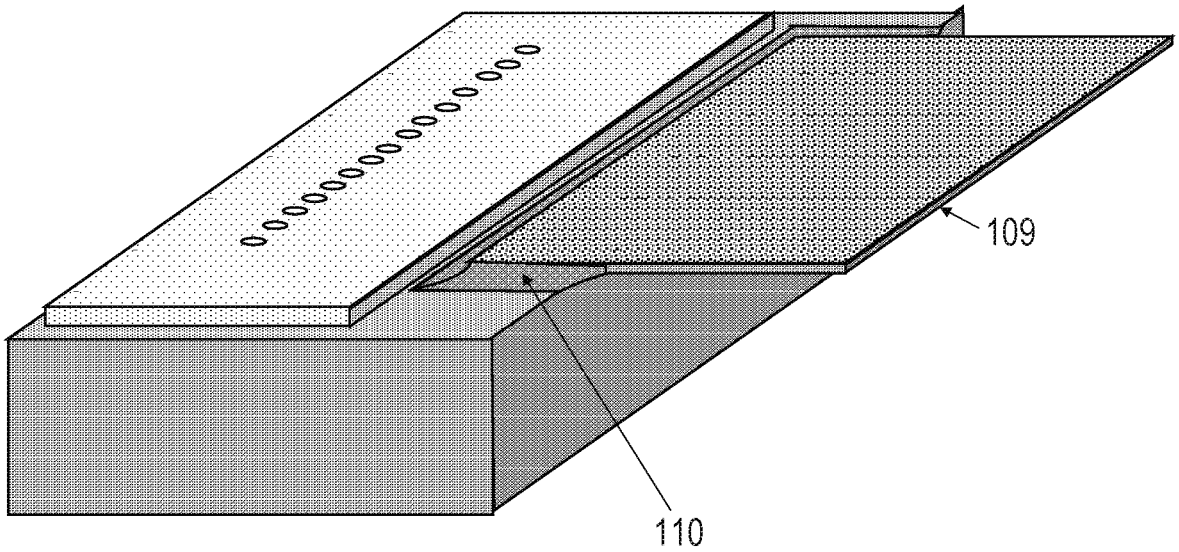
FIG. 15 is a perspective view of a manufacturing step subsequent to FIG. 14A and FIG. 14B of the inkjet recording head according to another embodiment of the present disclosure.
Figure 16A:
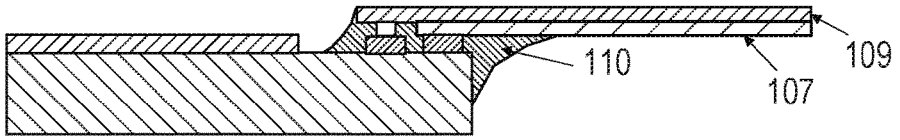
FIG. 16A is a cross-sectional view taken along line XVIA-XVIA of FIG. 16B.
Figure 16B:
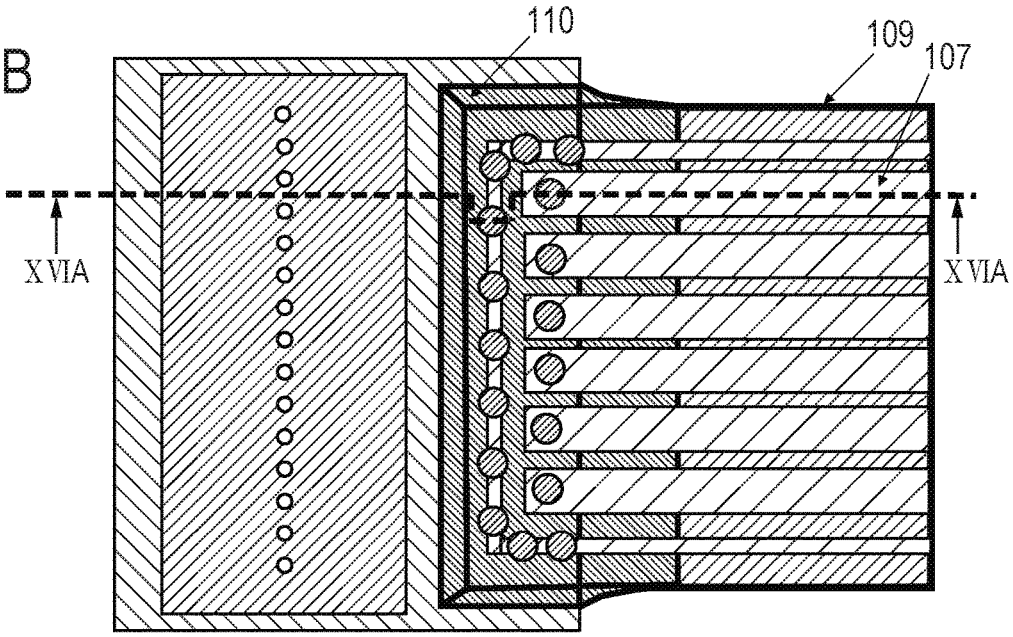
FIG. 16B is a perspective view seen from the front surface side of the external wiring board.
Figure 17:
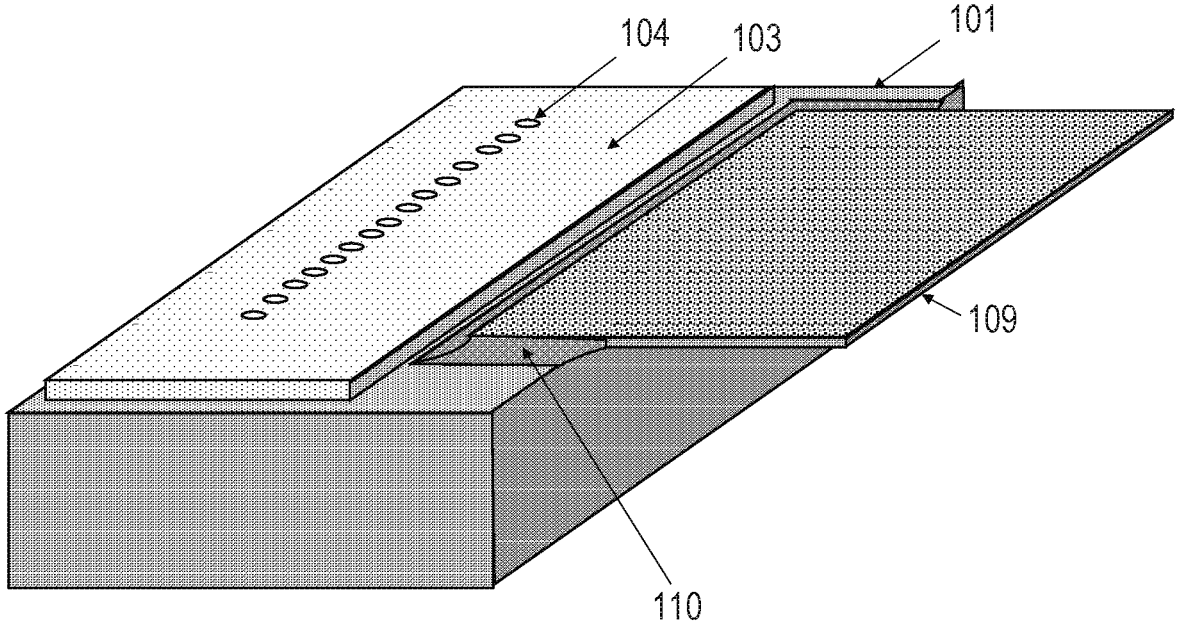
FIG. 17 is a perspective view of a conventional inkjet recording head.
Figure 18A:
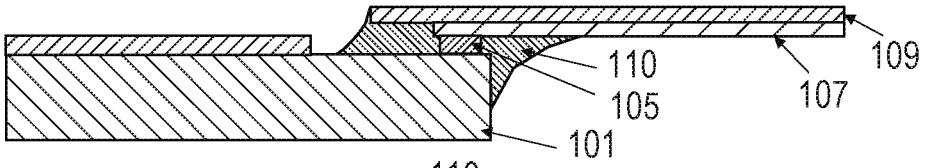
FIG. 18A is an explanatory diagram of the conventional inkjet recording head and is a cross-sectional view taken along line XVIIIA-XVIIIA of FIG. 18B.
Figure 18B:
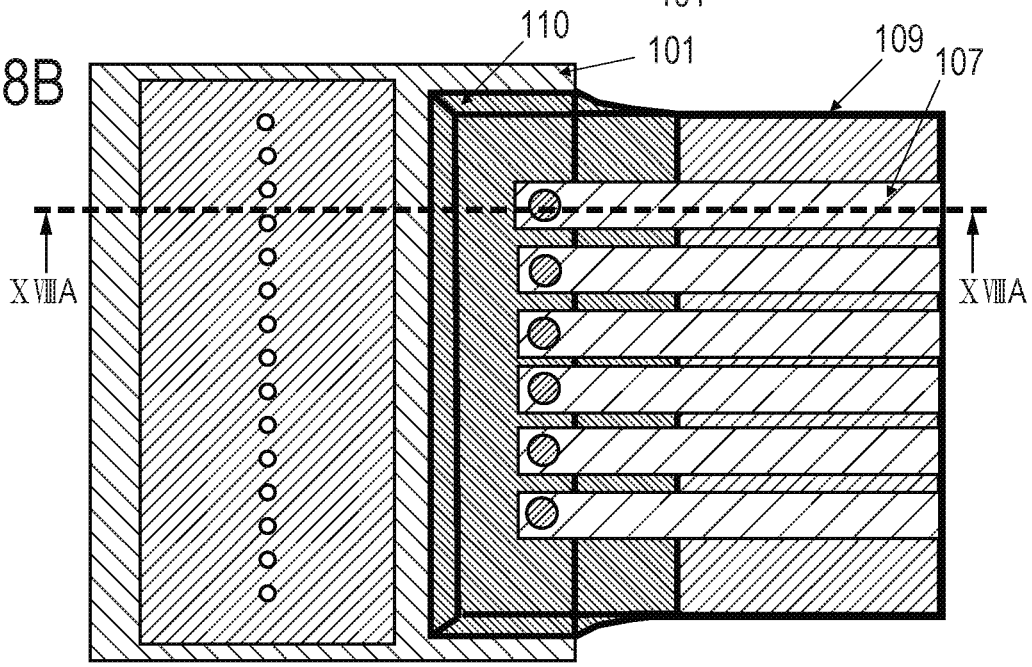
FIG. 18B is an explanatory view of the conventional inkjet recording head, and is a perspective view seen from the front surface side of the external wiring board.

After forming the electrode pads 102 and the orifice portion 103 as illustrated in FIG. 16A, FIG. 16B and FIG. 9, a plurality of bump-shaped first spacers 111 is formed as illustrated in FIG. 10. The bump-shaped first spacers 111 can be formed simultaneously with the electrode bumps 105 using the same material and in the same method. The bump-shaped first spacers 111 and the electrode bumps 105 can have the same height. In FIG. 10, the bump-shaped first spacers 111 are arranged in a U shape so as to surround both ends in the array direction of the electrode bumps 105. Except that the first spacers 111 are formed in this way, the ejection module can be manufactured in the same manner as in the manufacturing method of the structure illustrated in FIG. 1, FIG. 2A and FIG. 2B according to the steps illustrated in FIG. 9 to FIG. 16A and FIG. 16B.

EXAMPLES

Hereinafter, examples of the present disclosure will be described with reference to the drawings.

Example 1

First, the ejection chip illustrated in FIG. 4 was manufactured as follows. Heating resistors as the pressure generating elements were formed on the silicon substrate 101 by film formation and etching. Next, electrical wirings that drive the heating resistors and distribute an electrical signal for heating the ink were formed by film formation and etching. Then, a protective film for protecting the heating resistors and the electrical wirings from the ink was formed thereon. After that, the electrode pads 102 for connecting to the external wiring board were formed by patterning the protective film. Sixteen heating resistors were arrayed at 150 dpi, and the array length thereof was 2.7 mm. The electrode pad had a protective film opening size of 0.1 mm×0.1 mm, arrayed in a pitch of 0.185 mm, and had the array length of 1.11 mm.

Figure 3:
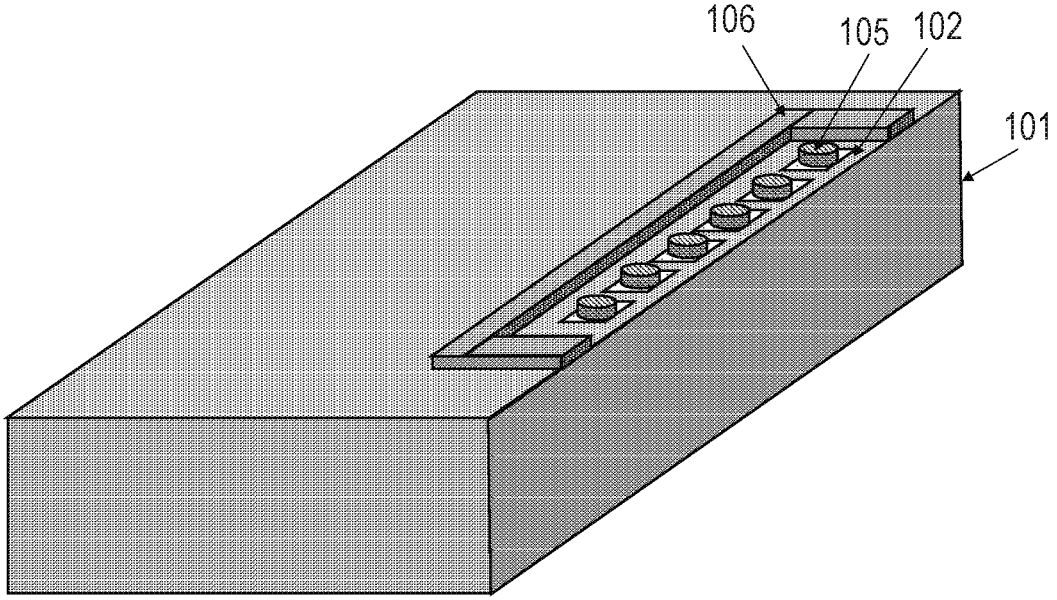
FIG. 3 is a perspective view of a manufacturing step of the inkjet recording head according to the embodiment of the present disclosure.

Next, as illustrated in FIG. 3, each of the electrode bumps 105 corresponding to the electrode pads was formed by gold plating with a diameter of 75 μm and a height of 10 μm, and the first spacer 106 was formed with a width of 100 μm and a height of 10 μm around the electrode pads and the electrode bumps.

Next, the ink supply ports were formed on the silicon substrate by dry etching. Next, a photosensitive resin was laminated thereon and communicated with the ink supply ports by photolithography to form nozzles (flow path) including the pressure generating element formation region, and subsequently, a photosensitive resin was laminated to form the orifice portion 103 having the ejection orifices 104 by photolithography. The ejection orifices 104 were formed corresponding to the heating resistors, and sixteen ejection orifices were arrayed at 150 dpi, and the length of the array of ejection orifices was 2.7 mm. The chip width of the ejection chip in the ejection orifice array direction was 3 mm. In this way, the ejection chip illustrated in FIG. 4 was obtained.

On the other hand, as illustrated in FIG. 5, a copper foil (thickness of 35 μm) was laminated on the base film 109*b* (thickness of 50 μm) made of Upilex (registered trademark), and the external wiring pattern (100 μm width) 107 and the second spacer 108 were formed by etching. Subsequently, nickel and gold were plated thereon to form gold on the uppermost layer of the external wiring pattern and the second spacer. After that, the film was punched with a mold to obtain the external wiring board 109 illustrated in FIG. 5.

Next, as illustrated in FIG. 5 to FIG. 8A and FIG. 8B, an external wiring board was attached to the ejection chip. In this case, the electrode bumps 105 and the first spacer 106 of the ejection chip were respectively metal-joined to the external wirings 107 and the second spacer 108 of the external wiring board by ultrasonic waves and heat. After that, the resin sealing material was poured into the gap between the external wiring board and the substrate of the ejection chip, and cured by thermal baking. In this way, the ejection module illustrated in FIG. 1, FIG. 2A and FIG. 2B was obtained.

Figure 8A:
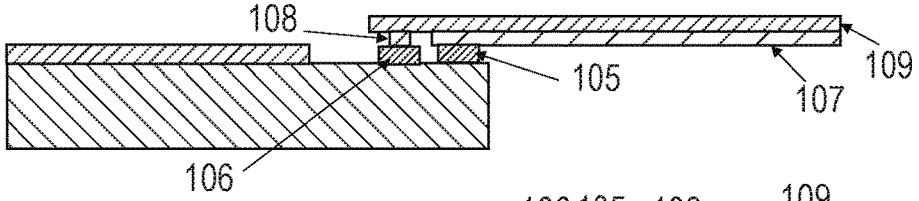
FIG. 8A is a cross-sectional view taken along line VIIIA-VIIIA of FIG. 8B.
Figure 8B:
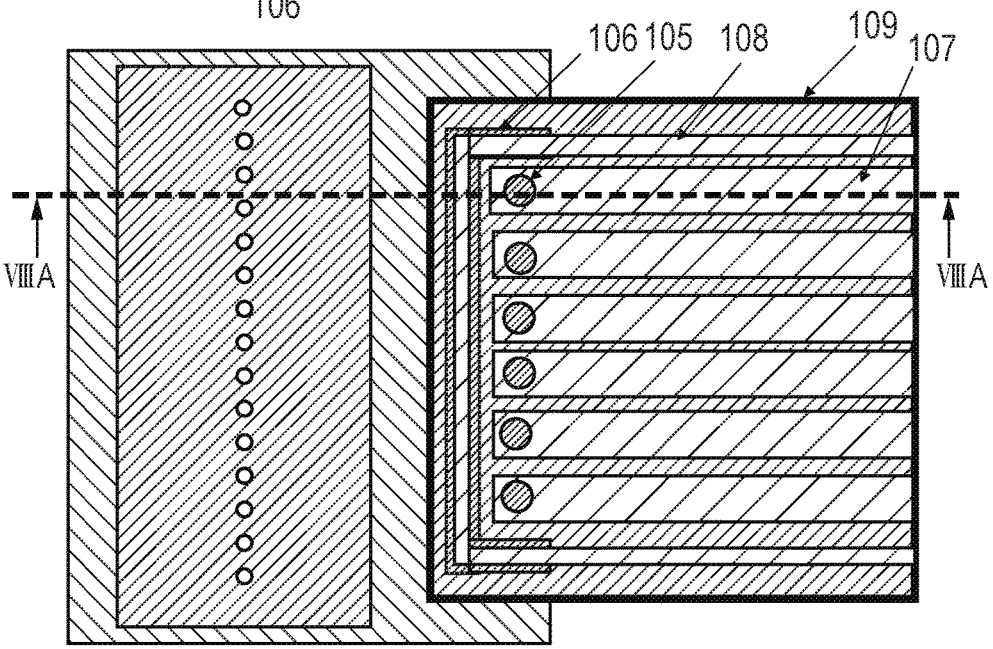
FIG. 8B is a perspective view seen from the front surface side of the external wiring board.

As illustrated in FIG. 8A and FIG. 8B, the electrode bumps 105 and the first spacer 106 are two-dimensionally arranged. Therefore, the external wiring board could be joined to the ejection chip without being inclined. As a result, reliability of joining was improved. The gap between the ejection chip and the external wiring board was constant, and the resin sealing material could be stably poured by the capillary force.

The first spacer 106 of the ejection chip and the second spacer 108 of the external wiring board corresponding to the first spacer 106 are metal-joined on the outside of the joining portions between the electrode bumps 105 corresponding to the electrode pad of the ejection chip and the external wirings 107 of the external wiring board. The metal joining portion serves as a blocking wall for ink that penetrates into the resin-sealed portion from the outside. With this configuration, since the ink does not reach the electrode pads 102, the electrode bumps 105, and the external wirings 107, corrosion due to the ink is prevented and electrical reliability is improved.

Example 2

FIG. 15, FIG. 16A and FIG. 16B illustrate an ejection module (ejection chip electrically joined to an external wiring board) of an inkjet recording head manufactured in Example 2. Instead of the linear first spacers 106 illustrated in FIG. 3 and FIG. 4 of Example 1, a plurality of bump-shaped first spacers 111 illustrated in FIG. 10 is arranged around the electrode bumps 105. After forming the orifice portion 103 including the ejection orifices 104, the metal bumps 105 and the bump-shaped first spacers 111 are formed by a wire bonding method. In the other steps, the inkjet recording head was manufactured in the same manner as in Example 1. By forming the plurality of electrode bumps 105 and the plurality of bump-shaped first spacers 111, respectively, after forming the orifice portion including the ejection orifices, the degree of freedom in height of both the electrode bump 105 and the bump-shaped first spacer 111 is increased.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-147530, filed Aug. 9, 2019, which is hereby incorporated by reference herein in its entirety.

What is claimed is:

1. An inkjet recording head comprising:

an ejection chip including pressure generating elements, a substrate in which electrode bumps are formed, and a member in which a plurality of ejection orifices for performing ejection are formed;

an external wiring board including external wirings for applying an electrical signal from the outside to the ejection chip;

an electrical joining portion in which the electrode bumps and the external wirings chip are electrically joined;

a resin-sealed portion for sealing the electrical joining portion;

a first spacer provided on a surface of the substrate in which the electrode bumps are formed, in a region between the electrode bumps and the member in which the ejection orifices are formed; and a second spacer provided on a surface of the external wiring board in which the external wirings are formed, in a region outside a formation region of the external wirings, wherein electrode bumps of the ejection chip and the external wirings in the external wiring board are joined to each other in the electrical joining portion, and the first spacer and the second spacer are joined to each other.

2. The inkjet recording head according to claim 1, wherein a plurality of the electrode bumps is arrayed, and the first spacer is arranged along an array direction of the plurality of electrode bumps, in at least the same length as a length of an array of the plurality of electrode bumps.

3. The inkjet recording head according to claim 2, wherein the first spacer is a linear spacer extending along the array direction of the plurality of electrode bumps.

4. The inkjet recording head according to claim 2, wherein the first spacer is a bump-shaped spacer, a plurality of which is arrayed along the array direction of the plurality of electrode bumps.

5. The inkjet recording head according to claim 2, wherein the first spacer is arranged in a U shape so as to surround both ends in the array direction of the plurality of electrode bumps.

6. The inkjet recording head according to claim 1, wherein a plurality of the external wirings is arrayed, and the second spacer is arranged, along a first end portion of the external wiring board on a side of the ejection chip, in at least the same length as a length of an array of the plurality of external wirings.

7. The inkjet recording head according to claim 6, wherein the second spacer includes a linear portion extending along the first end portion, and the linear portion has at least the same length as the length of the array of the plurality of external wirings.

8. The inkjet recording head according to claim 6, wherein the second spacer follows arrangement of the first spacer and is arranged so as to surround the external wirings on both outer sides of the array of the plurality of external wirings.

9. The inkjet recording head according to claim 1, wherein a joining thickness between each of the electrode bumps of the ejection chip and each of the external wirings of the external wiring board is the same as a joining thickness between the first spacer and the second spacer.

10. The inkjet recording head according to claim 1, wherein the external wiring board has a width shorter than a width of the ejection chip in an ejection orifice array direction, and an end portion of the external wiring board is arranged along the ejection orifice array direction of the ejection chip, and in a portion where the external wiring board and the ejection chip overlap, the electrode bumps of the ejection chip and the external wirings of the external wiring board are joined to each other, and the first spacer and the second spacer are joined to each other.

11. The inkjet recording head according to claim 1, wherein the first spacer and the second spacer are made of a conductive material, and the second spacer is set to a ground GND potential.

12. The inkjet recording head according to claim 1, wherein the ejection chip includes the pressure generating elements provided corresponding to the ejection orifices, electrical wirings for transmitting an electrical signal to the pressure generating elements, and lead-out electrode pads electrically connected to the electrical wirings on a substrate, and the external wirings of the external wiring board are electrically joined to the lead-out electrode pads of the ejection chip via the electrode bumps.

13. The inkjet recording head according to claim 1, wherein a joining surface of the electrode bump and the external wiring, and a joining surface of the first spacer and the second spacer are along each other.

* * * * *